US010612334B2

(12) United States Patent
Quintana Martinez et al.

(10) Patent No.: US 10,612,334 B2
(45) Date of Patent: Apr. 7, 2020

(54) CORING INNER BARREL CONNECTIONS FOR CORE OF ROCK PROTECTION

(71) Applicant: Halliburton Energy Services, Inc., Houston, TX (US)

(72) Inventors: Luis Enrique Quintana Martinez, Brussels (BE); Nuno Da Silva, Brussels (BE)

(73) Assignee: Halliburton Energy Services, Inc., Houston, TX (US)

( * ) Notice: Subject to any disclaimer, the term of this patent is extended or adjusted under 35 U.S.C. 154(b) by 132 days.

(21) Appl. No.: 15/741,057

(22) PCT Filed: Mar. 29, 2016

(86) PCT No.: PCT/US2016/024725
§ 371 (c)(1),
(2) Date: Dec. 29, 2017

(87) PCT Pub. No.: WO2017/023369
PCT Pub. Date: Feb. 9, 2017

(65) Prior Publication Data

US 2018/0195358 A1 Jul. 12, 2018

Related U.S. Application Data

(60) Provisional application No. 62/199,726, filed on Jul. 31, 2015.

(51) Int. Cl.

| | |
|---|---|
| ***E21B 25/10*** | (2006.01) |
| ***E21B 10/02*** | (2006.01) |
| ***E21B 25/02*** | (2006.01) |

(52) U.S. Cl.
CPC ..... *E21B 25/10* (2013.01); *E21B 10/02* (2013.01); *E21B 25/02* (2013.01)

(58) Field of Classification Search
CPC ..... E21B 25/10; E21B 25/02; E21B 10/02
See application file for complete search history.

(56) References Cited

U.S. PATENT DOCUMENTS

| | | |
|---|---|---|
| 3,363,705 A | 1/1968 | Jensen |
| 3,441,098 A | 4/1969 | Martinsen |

(Continued)

FOREIGN PATENT DOCUMENTS

| | | |
|---|---|---|
| CA | 2083827 | 12/1991 |
| CA | 2065142 | 10/1992 |

(Continued)

OTHER PUBLICATIONS

International Search Report and Written Opinion received for PCT Patent Application No. PCT/US2015/024725, dated Jun. 30, 2016; 14 pages.

(Continued)

*Primary Examiner* — Brad Harcourt
(74) *Attorney, Agent, or Firm* — Baker Buotts L.L.P.

(57) ABSTRACT

Systems and methods for a protective connection for coring inner barrels are disclosed. A coring apparatus includes a first inner barrel, a second inner barrel, and a tubular extension between adjacent ends of the first and second inner barrels. The coring apparatus includes an outer connector member moveably positioned about the tubular extension and configured for releasably connecting the first and second inner barrels. The first and second inner barrels and tubular extension define a substantially continuous tubular inner structure to receive a core sample.

18 Claims, 6 Drawing Sheets

(56) References Cited

U.S. PATENT DOCUMENTS

| | | | | |
|---|---|---|---|---|
| 4,156,469 | A * | 5/1979 | Laskey | E21B 25/06 175/226 |
| 5,107,942 | A | 4/1992 | Radford | |
| 5,482,123 | A | 1/1996 | Collee | |
| 6,009,960 | A | 1/2000 | Leitko, Jr. et al. | |
| 6,095,259 | A | 8/2000 | Keyes | |
| 6,116,358 | A | 9/2000 | Fanuel | |
| 6,148,664 | A | 11/2000 | Baird | |
| 6,230,825 | B1 | 5/2001 | Aumann et al. | |
| 6,394,196 | B1 | 5/2002 | Fanuel et al. | |
| 7,055,626 | B2 | 6/2006 | Wells et al. | |
| 7,146,704 | B2 | 12/2006 | Otten et al. | |
| 7,231,991 | B2 | 6/2007 | Puymbroeck et al. | |
| 2006/0169496 | A1 | 8/2006 | Puymbroeck et al. | |
| 2014/0027182 | A1 | 1/2014 | Wilson | |
| 2014/0158377 | A1 | 6/2014 | Hollier | |

FOREIGN PATENT DOCUMENTS

| | | |
|---|---|---|
| EP | 0531336 | 12/1991 |
| EP | 0508329 | 10/1992 |
| WO | 1991-019075 | 12/1991 |
| WO | 2014-070183 | 5/2014 |

OTHER PUBLICATIONS

Advanced Coring, ALS Corpro, http://www.corpro-group.com/service-offering/downhole-equipment/advanced-coring, 4 pgs, Apr. 20, 2015.

Wireline Casing, Hole Products, http://www.holeproducts.com/products/WT---Casing?categoryId=287, 9 pgs, Apr. 20, 2015.

In Hole Tools, Global Performance Tooling Catalog, Boart Longyear, http://app.boartlongyear.com/brochures/InHoleTools_Catalog_May_2013(App).pdf 17 pgs, 2013.

* cited by examiner

CORING INNER BARREL CONNECTIONS FOR CORE OF ROCK PROTECTION

RELATED APPLICATIONS

This application is a U.S. National Stage Application of International Application No. PCT/US2016/024725 filed Mar. 29, 2016, which designates the United States, and claims priority to U.S. Provisional Application No. 62/199,726 filed Jul. 31, 2015, which are incorporated herein by reference in their entirety.

TECHNICAL FIELD

The present disclosure relates generally to downhole coring operations and, more particularly, to coring tools with coring inner barrel connections for core of rock protection.

BACKGROUND

An example of a coring tool for obtaining core samples from a borehole contains a tubular housing attached at one end to a special bit often referred to as a core bit, and at the other end to a drill string extending through the borehole to the surface. The tubular housing is usually referred to as an outer barrel. The outer barrel contains an inner barrel with a space, or annulus, that separates the outer barrel from the inner barrel. During a typical coring operation, the core bit drills into a formation of rock and a core sample, such as a core of rock, is preserved for extraction. The core sample enters and fills the inner barrel, which is then subsequently retrieved to the surface.

BRIEF DESCRIPTION OF THE DRAWINGS

For a more complete understanding of the present disclosure, its features and advantages, reference is now made to the following description, taken in conjunction with the accompanying drawings, in which.

DETAILED DESCRIPTION

Figure 1:
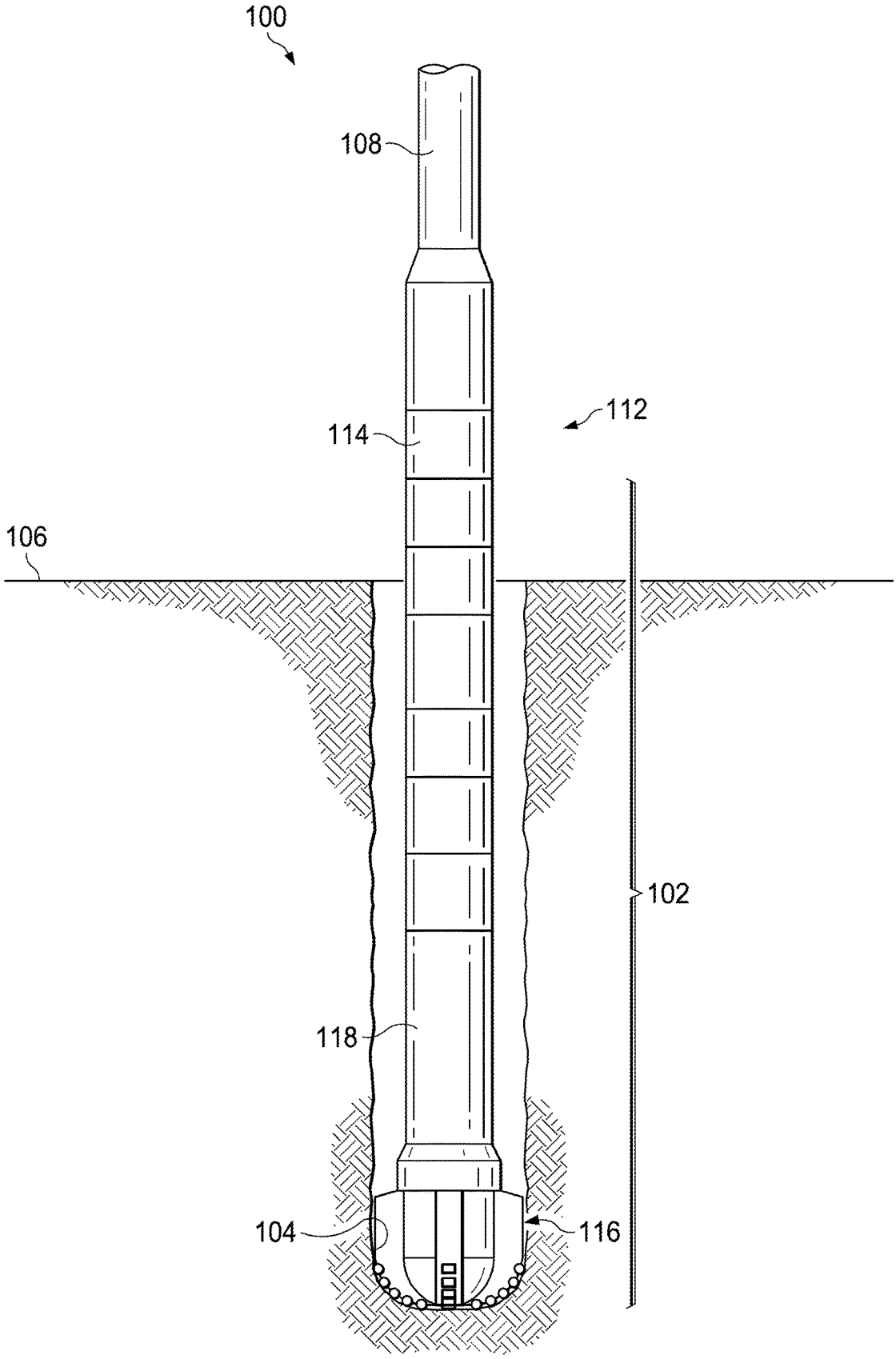
FIG. 1 is an elevation view, with portions broken away, of a drilling system at a well site.

The present disclosure relates to coring apparatuses and methods for obtaining a core sample that may protect the full length of the core sample from initial retrieval to subsequent rig processing and transportation. An example of a coring tool or apparatus may include a plurality of inner barrels connected at adjacent ends with a releasable protective connection. The coring apparatus (or optionally, the protective connection itself) may include an inner, tubular extension and an outer connector member positioned about the tubular extension. The tubular extension may be positioned in coaxial alignment between the two inner barrels, thus defining a substantially-continuous tubular inner structure to receive the core sample. (Substantially-continuous in this context envisions that there may exist seams or slight gaps, such as due to tolerance mismatch or other manufacturing irregularities, or wear and tear, between tubular components, and that such imperfections do not significantly reduce the protection afforded by the structures and relationships described herein.) Further, an intentional gap may be provided, such as between the tubular extension and an end of one of one of the inner barrels, leaving a corresponding distance of exposed core sample between any of the tubular extensions and the inner barrels or other tubular extensions to allow shearing or otherwise severing of the core sample without shearing or otherwise severing the inner barrels. (Substantially-continuous in this context instead envisions that there may exist an intentional gap, which may be large enough to allow a blade or other cutting element to sever the core sample without severing the inner barrels, and that such intentional gap does not significantly reduce the protection afforded by the structures and relationships described herein.) The outer connector member may be used to connect the adjacent ends of the first and second inner barrel, with the tubular extension shielding the core sample from movement of the outer connector member. Such movement of the outer connector member may include, for example, rotation and/or axial sliding of the outer connector member relative to the core sample in a process of subsequently disconnecting the two inner barrels at some time after obtaining the core sample.

Any of a variety of connections and connector configurations may be used to releasably connect the first and second inner barrels. By way of example, and not by limitation, one or more threaded connection may be used to releasably connect the two inner barrels. For example, at least one inner (e.g. male) thread on the outer connector member may mate with a corresponding outer (e.g. female) thread on a respective at least one of the inner barrels. The outer connector member may be rotatably connected to the other inner barrel, such as with a permanent swivel mount or an additional threaded connection. Thus, connecting the first and second inner barrels may comprise rotating the outer connector member to engage corresponding threads between the outer connector member and at least one of the inner barrels; and subsequently releasing that connection may include rotating the outer connector member in an opposite direction to disengage the corresponding threads between the outer connector member and one of the inner barrels. Other connector configurations may include a so-called "quick release" type connector mechanism on the outer connector member that axially slides over the inner tubular extension to selectively couple or de-couple at least one of the inner barrels. In any of these configurations, the core sample is protected from movement of the outer connector member, and such movement includes rotating, sliding, or both, with respect to the core sample.

The inner, tubular extension described above and below may belong to or be included with the first inner barrel, the second inner barrel, or the outer connector member. The threaded connection may, for example, include one or more threaded connector subs as further described below. One or both of the inner barrels may include the tubular extension (i.e. lip), that extends from an end of the respective inner barrel to the adjacent end of the other inner barrel. The outer connector member may be or include a connector sub. The connector sub may surround at least a portion of the tubular extension, with the tubular extension shielding the core sample along a region of the core sample between adjacent ends of the inner barrels, so as to leave the core sample relatively undisturbed upon disconnecting the connector sub to separate the threaded barrels. Alternatively, the connector sub may include a tubular extension that extends from an end of a portion of the connector sub.

Additionally, since the tubular extension may extend from the inner barrel or connector sub, the tubular extension protects the core sample from damage or impact experienced during separation of the inner barrels and severing of the core sample into sections. Including the tubular extension on the inner barrels or connector subs may minimize contact between rotating components, such as the connector subs, and the core sample. Further, rig time and associated expense necessary for severing the inner barrels is mitigated because, using systems of the present disclosure, the inner barrels may not require severing. Because the tubular extensions remain on the core sample, the tubular extensions also protect the core sample during handling at the well site, which may include separating the inner barrels, storing the core samples in a box, and transporting the core sample from the well site to a remote location. Accordingly, the disclosed tools and methods may provide higher quality core samples and core sample measurements.

Embodiments of the present disclosure and their advantages may be better understood by referring to FIGS. 1-6, where like numbers are used to indicate like and corresponding parts.

FIG. 1 is an elevation view, with portions broken away, of a drilling system 100 at a well site 106. A drilling rig (not expressly shown) may be included at the well site 106 to support and operate a drill string 108 at the well site 108 for drilling a wellbore 104. Such a drilling rig may be used to suspend the drill string 108 over the well 104 as the well is drilled, and may include various types of drilling equipment normally included at such a well site, such as a rotary table, drilling fluid pumps, and drilling fluid tanks, used in drilling. Such a drilling rig may have various characteristics and features associated with a "land drilling rig," such as a rig floor. However, the present teachings are not limited to use with a land drilling rig, and may equally be used with offshore platforms, drill ships, semi-submersibles, and drilling barges.

The drill string 108 further includes a bottom hole assembly (BHA) 112. BHA 112 may be assembled from a plurality of various components that operationally assist in forming the wellbore 104 including extracting core samples from the wellbore 104. For example, the BHA 112 may include drill collars, rotary steering tools, directional drilling tools, downhole drilling motors, drilling parameter sensors for weight, torque, bend and bend direction measurements of the drill string and other vibration and rotational related sensors, hole enlargers such as reamers, stabilizers, measurement while drilling (MWD) components containing wellbore survey equipment, logging while drilling (LWD) sensors for measuring formation parameters, short-hop and long haul telemetry systems used for communication, and/or any other suitable downhole equipment. The number and different types of components included in the BHA 112 depend upon anticipated downhole drilling conditions and the type of wellbore that will be formed.

The BHA 112 may include a swivel assembly 114. The swivel assembly 114 may be an integrated component of a coring tool 102 used to isolate rotation of and torque used in rotation of a core bit 116 from other components of the coring tool 102, such as the inner barrel (as shown in FIG. 2).

The coring tool 102 (as shown in more detail in FIG. 2) is coupled to the drill string 108. The coring tool 102 and the drill string 108 extend downhole from the well site 106. The coring tool 102 includes the core bit 116, which has a central opening and may include one or more blades disposed outwardly from exterior portions of a bit body of the core bit 116. The bit body may be generally curved and the one or more blades may be any suitable type of projections extending outwardly from the bit body. The blades may include one or more cutting elements disposed outwardly from exterior portions of each blade. The core bit 116 may be any of various types of fixed cutter core bits, including matrix body core bits and steel body core bits, including polycrystalline diamond cutter (PDC) core bits, including thermally stable polycrystalline diamond cutter (TSP) core bits, and diamond impregnated (impreg) core bits operable to extract a core sample from the wellbore 104. The core bit 116 may have many different designs, configurations, or dimensions according to the particular application of the core bit 116. The coring tool 102 further includes an outer barrel 118 and an inner barrel (discussed in detail with reference to FIG. 2) located inside the outer barrel 118.

Figure 2:
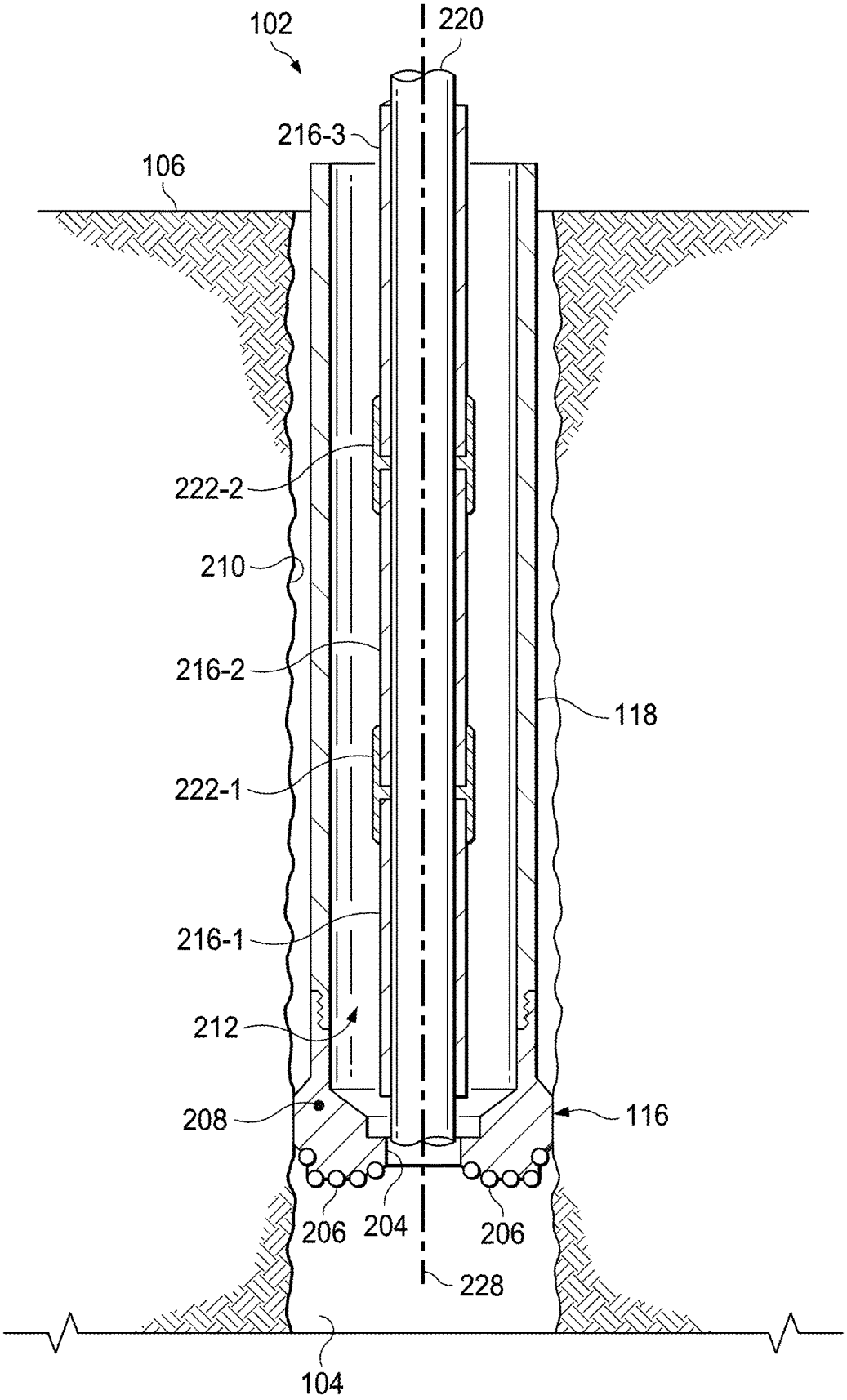
FIG. 2 is a cross-sectional view of an example coring tool, as shown in FIG. 1, used to extract and store, after extraction, a core sample from a wellbore.

FIG. 2 is a cross-sectional view of an example coring tool, as shown in FIG. 1, used to extract and store, after extraction, a core sample 220 from a wellbore 104. The coring tool 102 includes the core bit 116 that has a generally cylindrical body and includes a throat 204 that extends longitudinally through core bit 116. The throat 204 of the core bit 116 may receive a core sample 220. The core bit 116 includes one or more cutting elements 206 disposed outwardly from exterior portions of a core bit body 208. A portion of each cutting element 206 may be coupled to an exterior portion of the core bit body 208. Cutting elements 206 may be any suitable device configured to cut into a formation, including but not limited to, primary cutting elements, back-up cutting elements, secondary cutting elements or any combination thereof. By way of example and not limitation, cutting elements 206 may be various types of cutters, compacts, buttons, inserts, and gage cutters satisfactory for use with a wide variety of core bits 116.

In operation, the core bit 116 extracts the core sample 220 from a formation such that the core sample 220 has a diameter that is approximately equal to or less than the diameter of the throat 204. The core bit 116 may be coupled to or integrated with the outer barrel 118. The outer barrel 118 is separated from one or more inner barrels 216 by an annulus 212 that may have a generally cylindrical geometry. The outer barrel 118 may include barrel stabilizers (not expressly shown) to stabilize and provide consistent standoff of the outer barrel 118 from a sidewall 210. Further, the outer barrel 118 may include additional components, such as sensors, receivers, transmitters, transceivers, sensors, calipers, and/or other electronic components that may be used in a downhole measurement system or other particular implementation. The outer barrel 118 may be coupled to and remain in contact with well site 106 during operation.

The inner barrels 216-1, 216-2 and 216-3 (collectively "inner barrels 216") pass through the outer barrel 118. The inner barrels 216, or inner tubes, may form a tubular wall and have a generally cylindrical geometry. The tubular walls of the inner barrels 216 define a center axis 228 extending approximately through the center of the inner barrels 216. The inner barrels 216 may be housed in the outer barrel 118. In some configurations, the inner barrels 216 may extend beyond the outer barrel 118. The inner barrels 216 may be configured to slideably move uphole and downhole partially within the outer barrel 118.

The inner barrels 216 may house the core sample 220 extracted from the formation surrounding the wellbore 104. Following extraction from the wellbore 104, the core sample 220 is stored in the inner barrels 216 and later returned to the surface by retrieving the inner barrels 216 by wireline or by extraction of the whole coring assembly from the wellbore 104. Once the core sample 220 is returned to the surface, it may be severed, such as by cutting, shearing, or breaking, into multiple segments for box storage, transportation and further processing. For example, the core sample may be severed to separate the core sample in the inner barrel 216-1, the core sample in the inner barrel 216-2, and the core sample in the inner barrel 216-3.

Further, the connections 222-1 and 222-2 (collectively "connections 222") may operate to couple or connect the inner barrels 216. For example, the connection 222-1 couples the inner barrel 216-1 with the inner barrel 216-2. As another example, the connection 222-2 couples the inner barrel 216-2 with the inner barrel 216-3. The connections 222 may form a tubular wall and may be constructed of the same or similar material as the inner barrels 216. The tubular wall of the connections 222 may also define the center axis 228 extending approximately through the center of the inner barrels 216 and the connection 222. Further, the inner barrels 216 and/or the connection 222 may be coupled by a connector sub, an outer sub, a ring, or any other suitable coupling apparatus.

As discussed in further detail below, use of the inner barrels 216 and/or connections 222 of the present disclosure may minimize damage to the core sample 220 during severing and transport. For example, tubular extensions may extend from the ends of one or more inner barrels 216 or from a portion of the connection 222, such as a connector sub. The tubular extensions protect the core sample from damage when the inner barrels 216 are separated from each other and the core sample is severed into sections. Further, use of inner barrels 216 or a portion of a connection 222 with tubular extensions of the present disclosure may only expose a small portion of core sample 220 during severing, box storage, and transport. The connections 222 in conjunction with the inner barrels 216 having tubular extensions according to the present disclosure may ensure that no severing of the inner barrels 216 is necessary to sever the core samples because the tubular extensions may leave a sufficient amount of the core sample 220 exposed to allow severing once all or portions of the connection 222 are removed. Additionally, because the inner barrels 216 are not severed, the potential for disturbing the core sample 220 is reduced, and the rig time and associated expense necessary for severing the inner barrels 216 is also mitigated because the inner barrels 216 do not require severing. Systems of the present disclosure may also allow all or portions of the connections 222 to be retrievable and reused.

Figure 3A:
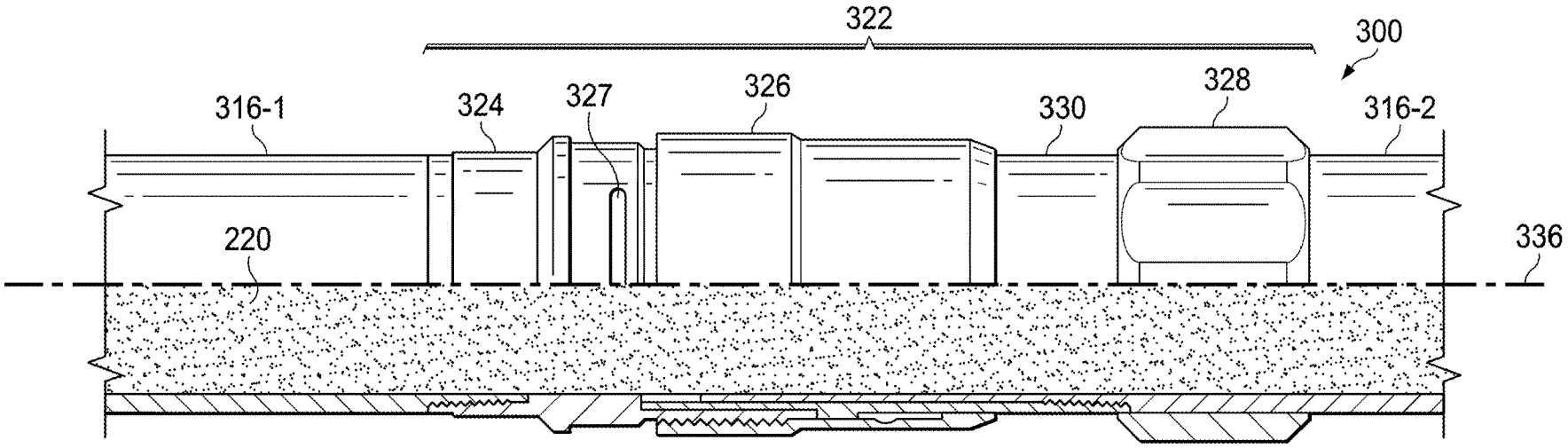
FIG. 3A is a partial cross-section view of an exemplary coring apparatus including inner barrels for housing a core sample coupled together by a protective connection.
Figure 3B:
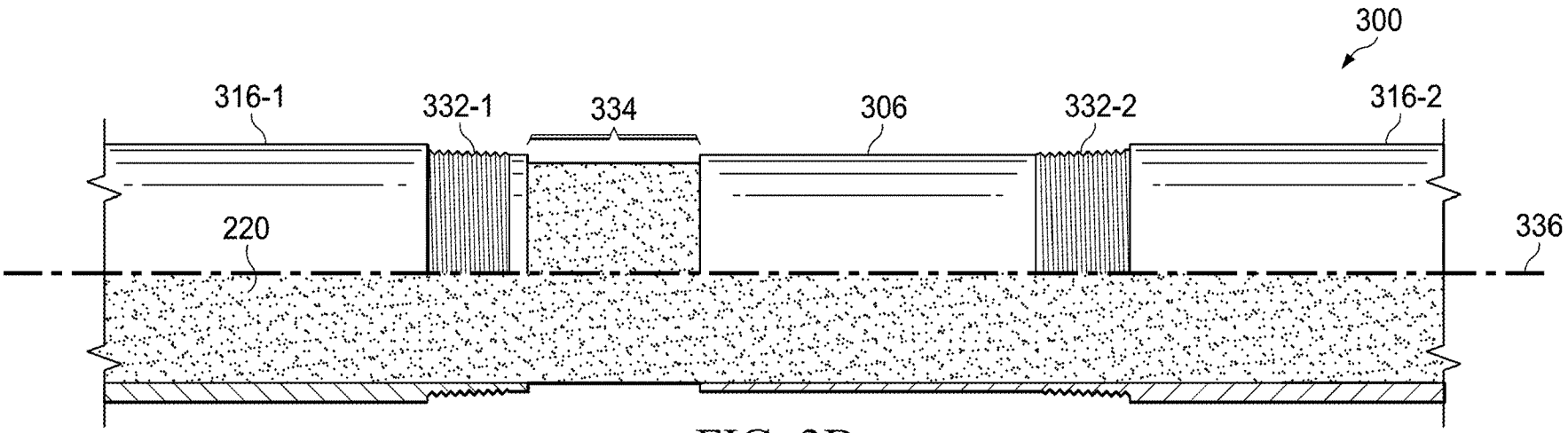
FIG. 3B is a partial cross-section view of the exemplary coring apparatus of FIG. 3A with portions of the connection removed and including a tubular extension extending from a threaded end of an inner barrel.

FIG. 3A is a partial cross-section view of an exemplary coring apparatus 300 including inner barrels 316 for housing a core sample 220 coupled together by a protective connection 322. The coring apparatus 300 includes a connection 322 and inner barrels 316-1 and 316-2. The tubular walls of the inner barrels 316 and the connection 322 define a center axis 336 extending approximately through the center of the inner barrels 316 and the connection 322. The connection 322 and inner barrels 316-1 and 316-2 are co-axially aligned longitudinally along the center axis 336. The connection 322 may include one or more outer connector members, such as, an upper connector sub 324, a lower connector sub 330, a union nut 326, a stabilizer 328, or other suitable components. The upper connector sub 324 may include a slot 327 to allow for severing of a portion of the core sample 220, which may be a core of rock, locally unprotected by a tubular extension, such as the tubular extension 306 as illustrated in FIG. 3B. The connection 322 may be configured to couple the inner barrels 316-1 and 316-2 by any suitable mechanism, such as, threaded ends, press fit threaded ends, or other appropriate devices. The connection 322 may be similar to the connections 222 shown in FIG. 2.

FIG. 3B is a partial cross-section view of the exemplary coring apparatus 300 of FIG. 3A with portions of the connection 322 removed and including a tubular extension 306 extending from a threaded end 332-2 of an inner barrel 316-2. The inner barrels 316-1 and 316-2 include threaded ends 332-1 and 332-2, respectively, for linking with portions of the connection 322 as shown in FIG. 3A. The inner barrels 316-1 and 316-2 are oriented such that the ends of each inner barrel 316-1 and 316-2 are towards each other as the inner barrels 316-1 and 316-2 extend longitudinally along the center axis 336. The threaded ends 332-1 and 332-2 may be located proximate the ends of the inner barrels 316-1 and 316-2, respectively. The inner barrel 316-2 may further include the tubular extension 306 extending longitudinally along the center axis 336 away from the threaded end 332-2 of the inner barrel 316-2. The tubular extension 306 may be of any suitable length and configured to protect the core sample 220 such that a minimum amount of the core sample 220 is exposed between the end of the tubular extension 306 and the inner barrel 316-1, shown by the gap 334. For example, the amount of the core sample 220 exposed (as illustrated by the distance corresponding to the gap 334) may allow for a blade or other suitable core-cutting tool to sever the core sample 220 without also severing the inner barrels 316. The inner barrels 316 may be similar to the inner barrels 216 shown in FIG. 2. Further, although the tubular extension 306 is shown on the inner barrel 316-2, the tubular extension 306 may be located on the inner barrel 316-1.

Figure 4A:
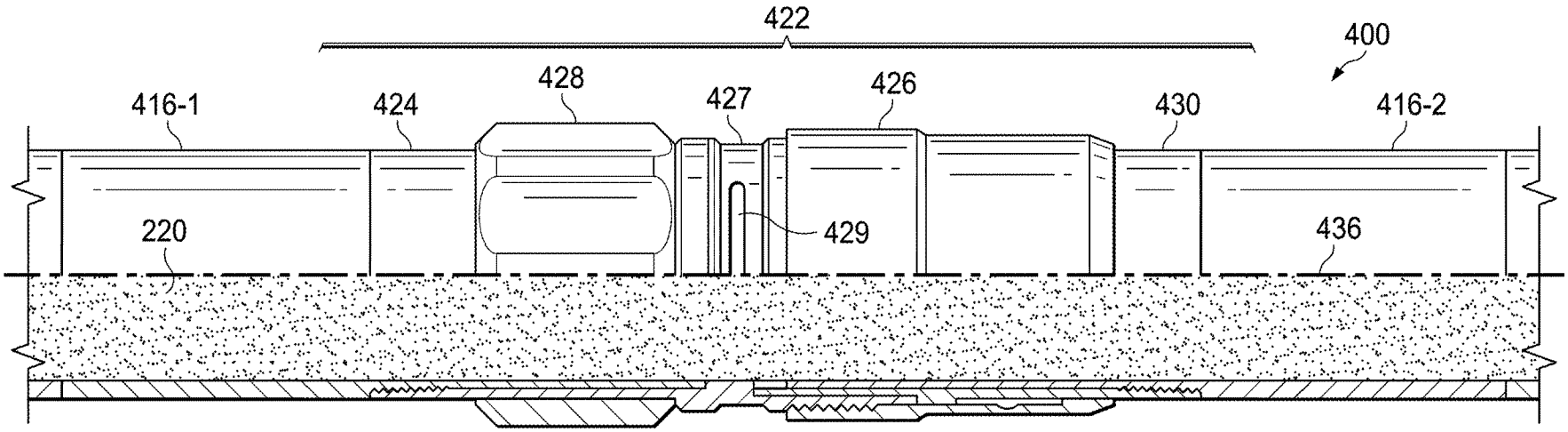
FIG. 4A is a partial cross-section view of an exemplary coring apparatus including inner barrels for housing a core sample coupled together by a protective connection.
Figure 4B:
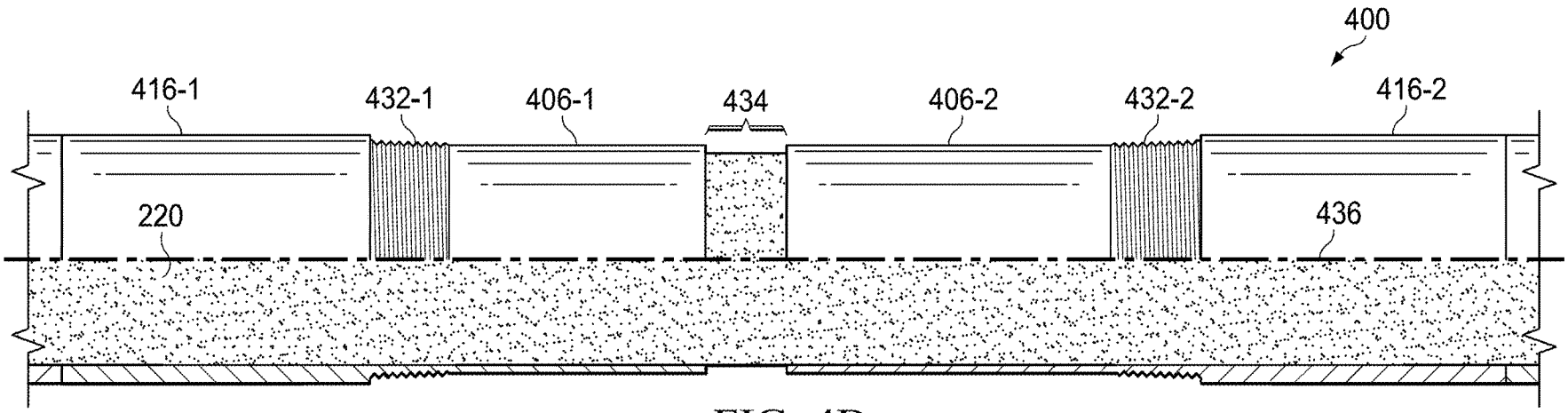
FIG. 4B is a partial cross-section view of the exemplary coring apparatus of FIG. 4A with portions of the connection removed and including tubular extensions extending from the threaded ends of the inner barrels.

FIG. 4A is a partial cross-section view of an exemplary coring apparatus 400 including inner barrels 416 for housing a core sample 220 coupled together by a protective connection 422. The coring apparatus 400 includes connection 422 and inner barrels 416-1 and 416-2. The tubular walls of the inner barrels 416 and the connection 422 define a center axis 436 extending approximately through the center of the inner barrels 416 and the connection 422. The connection 422 and inner barrels 416-1 and 416-2 are co-axially aligned longitudinally along the center axis 436. The connection 422 may include one or more outer connector members, such as, an upper connector sub 424, a union nut 426, a middle connector sub 427, a stabilizer 428, a lower connector sub 430, or other suitable components. The middle connector sub 427 may include a slot 429 to allow for severing of the portion of the core sample 220, which may be a core of rock, locally unprotected by tubular extensions, such as tubular extensions 406 as illustrated in FIG. 4B. The middle connector sub 427 of the connection 422 may be configured to couple the inner barrels 416-1 and 416-2 by any suitable mechanism, such as, threaded ends, press fit threaded ends, or other appropriate devices. The connection 422 may be similar to connections 222 shown in FIG. 2, and the connection 322 shown in FIG. 3A.

FIG. 4B is a partial cross-section view of the exemplary coring apparatus 400 of FIG. 4A with portions of the connection 422 removed and including tubular extensions 406 extending from the threaded ends 432 of the inner barrels 416. The inner barrels 416-1 and 416-2 include threaded ends 432-1 and 432-2, respectively, for linking with portions of the connection 422 as shown in FIG. 4A. The inner barrels 416-1 and 416-2 are oriented such that the ends of each inner barrel 416-1 and 416-2 are towards each other as the inner barrels 416-1 and 416-2 extend longitudinally along the center axis 436. The threaded ends 432-1 and 432-2 may be located proximate the ends of the inner barrels 416-1 and 416-2, respectively. The inner barrel 416-1 may further include a tubular extension 406-1 extending longitudinally along the center axis 436 away from the threaded end 432-1 of inner barrel 416-1. The inner barrel 416-2 may include a tubular extension 406-2 extending longitudinally along the center axis 436 away from the threaded end 432-2 of the inner barrel 416-2. The tubular extensions 406-1 and 406-2 may be any suitable length and may each be a different length. The tubular extensions 406-1 and 406-2 may be configured to protect the core sample 220 such that a minimum amount of the core sample 220 is exposed between the end of the tubular extensions 406-1 and 406-2, shown by the gap 434. For example, the amount of the core sample 220 exposed (as illustrated by the distance corresponding to the gap 434) allow for a blade or other suitable core-cutting tool to sever the core sample 220 without also severing the inner barrels 416. The inner barrels 416 may be similar to the inner barrels 216 shown in FIG. 2, and the inner barrels 316 shown in FIG. 3A.

Figure 5A:
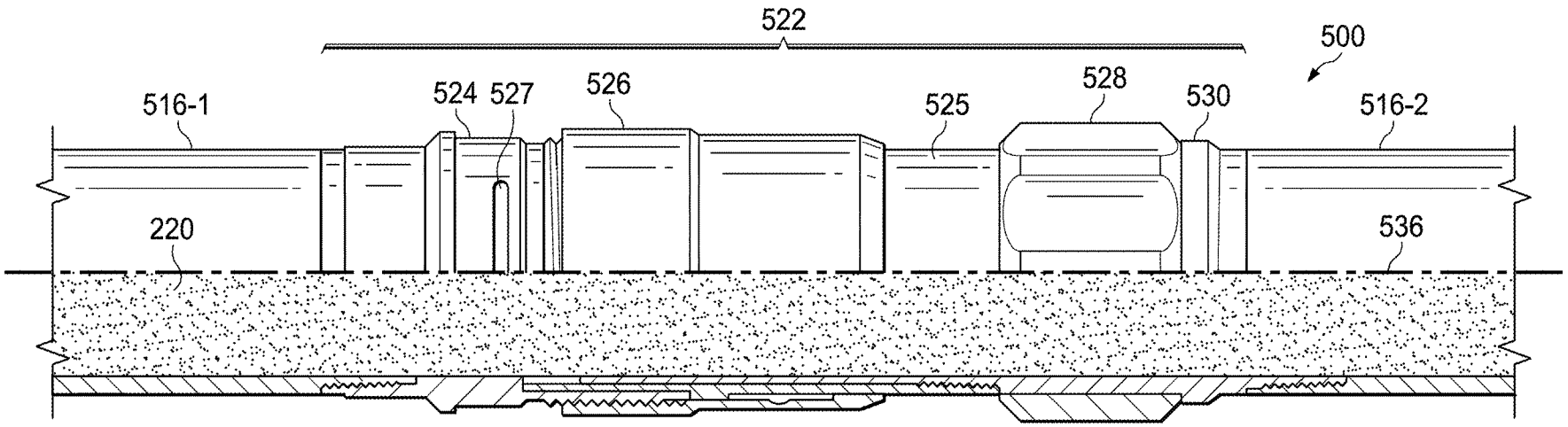
FIG. 5A is a partial cross-section view of an exemplary coring apparatus including inner barrels for housing a core sample coupled together by a protective connection.
Figure 5B:
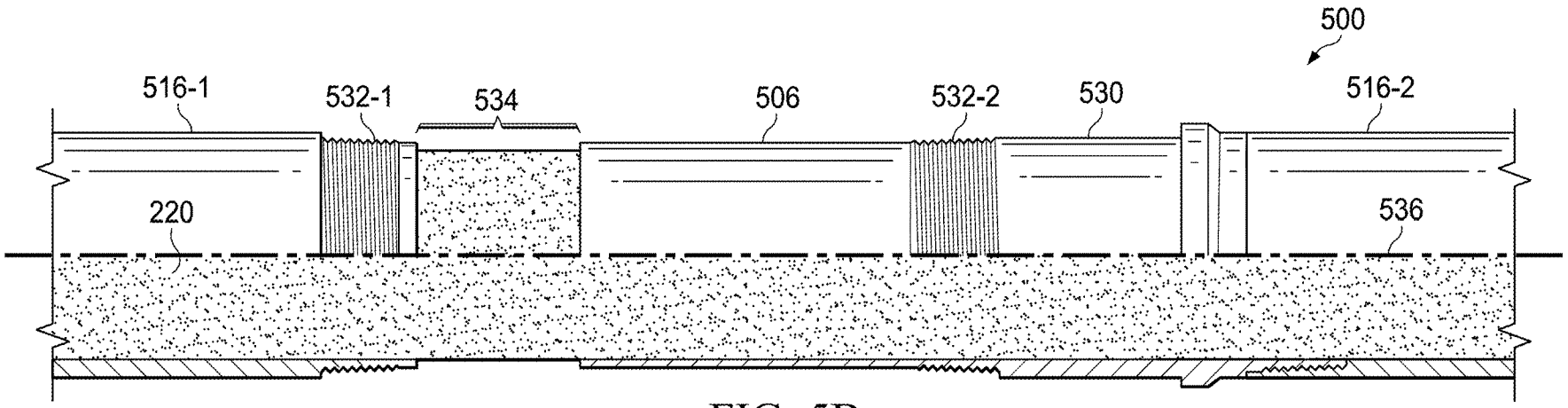
FIG. 5B is a partial cross-section view of the exemplary coring apparatus of FIG. 5A with portions of the connection removed and including a tubular extension extending from a lower connector sub.

FIG. 5A is a partial cross-section view of an exemplary coring apparatus 500 including inner barrels 516 for housing a core sample 220 coupled together by a protective connection 522. The coring apparatus 500 includes a connection 522 and inner barrels 516-1 and 516-2. The tubular walls of the inner barrels 516 and the connection 522 define a center axis 536 extending approximately through the center of the inner barrels 516 and the connection 522. The connection 522 and inner barrels 516-1 and 516-2 are co-axially aligned longitudinally along the center axis 536. The connection 522 may include one or more outer connector members, such as, an upper connector sub 524, a middle connector sub 525, a union nut 526, a stabilizer 528, a lower connector sub 530, or other suitable components. The upper connector sub 524 may include a slot 527 to allow for shearing of the portion of the core sample 220, which may be a core of rock, locally unprotected by a tubular extension, such as tubular extension 506 as illustrated in FIG. 5B. The connection 522 may be configured to couple the inner barrels 516-1 and 516-2 by any suitable mechanism, such as, threaded ends, press fit threaded ends, or other appropriate devices. The connection 522 may be similar to the connections 222 shown in FIG. 2, the connection 322 shown in FIG. 3A, and the connection 422 shown in FIG. 4A.

FIG. 5B is a partial cross-section view of the exemplary coring apparatus of FIG. 5A with portions of the connection 522 removed and including a tubular extension 506 extending from a lower connector sub 530. The inner barrel 516-1 and the lower connector sub 530 include threaded ends 532-1 and 532-2, respectively, for linking with portions of the connection 522 as shown in FIG. 5A. The inner barrels 516-1 and 516-2 are oriented such that the ends of each inner barrel 516-1 and 516-2 are towards each other as the inner barrels 516-1 and 516-2 extend longitudinally along the center axis 536. The threaded ends 532-1 and 532-2 may be located proximate the ends of the inner barrel 516-1 and the lower connector sub 530, respectively. The lower connector sub 530 may be coupled with or connected to the inner barrel 516-2. The lower connector sub 530 may further include a tubular extension 506 extending longitudinally along the center axis 536 away from the threaded end 532-2 of the lower connector sub 530. The tubular extension 506 may be any suitable length and may be configured to protect the core sample 220 such that a minimum amount of the core sample 220 is exposed between the end of the tubular extension 506 and the inner barrel 516-1, shown by the gap 534. For example, the amount of the core sample 220 exposed (as illustrated by the distance corresponding to the gap 534) may allow for a blade or other suitable core-cutting tool to sever the core sample 220 without also severing the inner barrels 516. In some cases, the tubular extension 506 may be positioned on the upper connector sub 524, on the middle connector sub 525, or on both the upper connector sub 524 and the lower connector sub 530. The inner barrels 516 may be similar to inner barrels 216 shown in FIG. 2, the inner barrels 316 shown in FIG. 3A, and the inner barrels 416 shown in FIG. 4A.

The connections 322, 422, or 522 may be configured to connect or couple the inner barrels 316, 416, or 516, respectively, prior to deployment of the inner barrels in the outer barrel. For example, at well site 106 as shown in FIG. 1, the connections may be used to couple a series of the inner barrels together. The connector subs of the connections, such as the upper connector sub, the middle connector sub, or the lower connector sub, include an interior threaded portion for connection with the inner barrels. The connections 322, 422, or 522 may be constructed of metal or any other suitable material based on the specific implementation.

The connections 322, 422, or 522 couple together the inner barrels and may fully or partially cover or enclose the tubular extensions extending from one or more of the inner barrels or a connector sub. During a coring operation, the core sample may be housed in the inner barrels, which may be returned to the surface. As the inner barrels return to the surface with an enclosed core sample, such as a core of rock, the connector subs allow for efficient disconnection of the inner barrels and separation of the extracted core into multiple core samples. The connector subs may be disconnected using a union nut and expose a minimum portion of the core sample. The tubular extensions on the inner barrels may protect the remainder of the core sample from being disturbed or core fluid from being lost. The core sample may be severed to separate the core sample in the different inner barrels. Because the tubular extensions extend longitudinally along a center axis from the ends of the inner barrels, the tubular extensions shield and protect the core sample. Only a small portion of the core sample may be exposed to allow severing of the core sample into multiple segments for further processing.

Using the present disclosure, no severing of the inner barrels may be necessary because a minimized amount of the core sample may be exposed when the connection between the inner barrels is removed. Because the inner barrels are not severed, the potential for disturbing the core sample is reduced. The rig time and associated expense necessary for severing the inner barrels is also mitigated because the inner barrels do not require severing. Additionally, the connector subs of the connection that couples the inner barrels may be retrievable and reused because at least portions of the connector subs are removed before the core sample is stored. The core sample may remain protected along its length during processing, box storage, and transportation. For example, core sample 220 may be separated into approximately thirty foot lengths that are laid down for further processing, storage and further transportation to other processing locations. The tubular extensions may prevent any moving part from contacting core sample 220 during return to the surface and separating of the core samples. When the inner barrels or a portion of the connection, such as the lower connector sub, includes a tubular extension that remains on the core sample, the tubular extension protects the core sample during transportation and processing operations. Further, a minimized length of the core sample 220 is exposed and unprotected and the risk of losing or mixing formation fluids is decreased. The amount of exposure of the core sample 220 may be further reduced by protecting core ends with added sleeves, foils, or caps.

Figure 6:
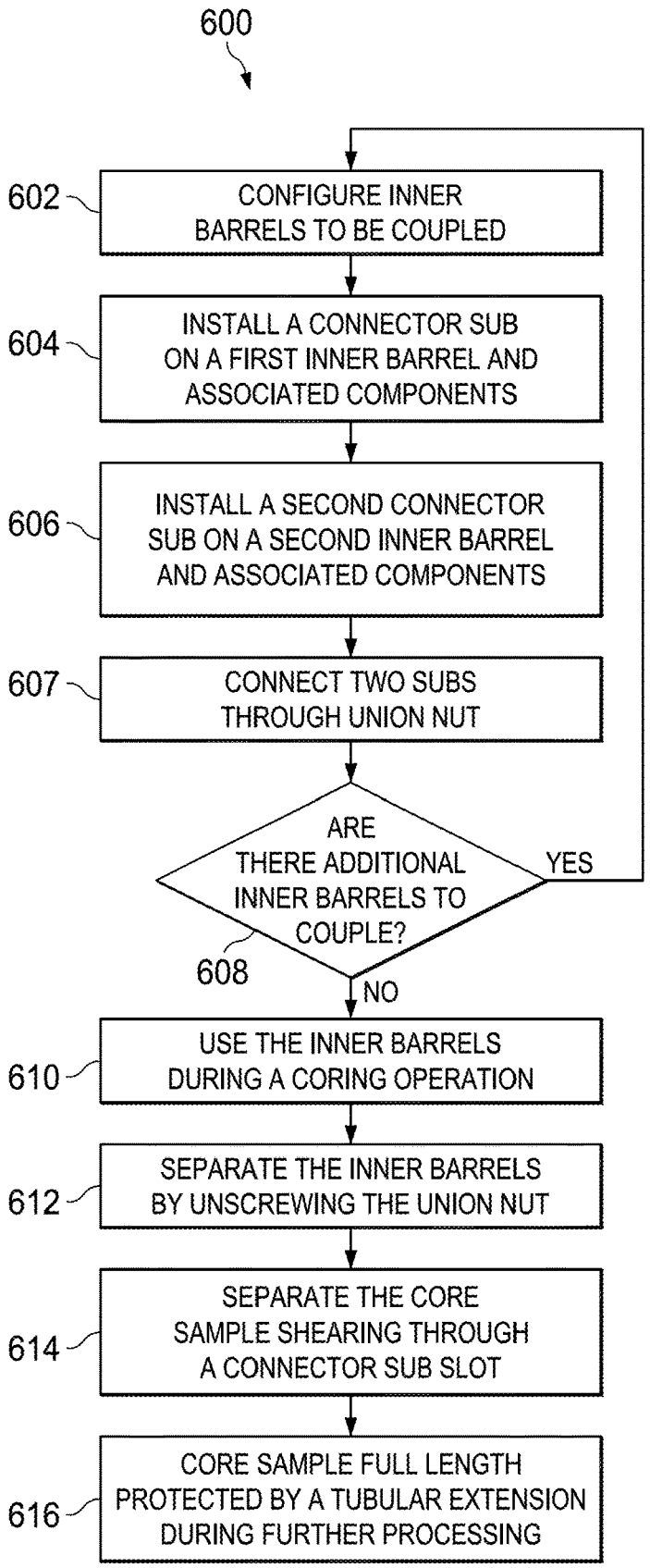
FIG. 6 is a flow chart of a method for protecting a core sample.

FIG. 6 is a flow chart of a method for protecting a core sample. At step 602, two inner barrels are configured to be coupled. For example, with reference to FIG. 3B, a configuration for the inner barrels may include a tubular extension 306 associated with one of the inner barrels (such as inner barrel 316-2) and extending longitudinally along a center axis 336 from a threaded end 332-2 of the inner barrel 316-2. As another example, with reference to FIG. 4B, a configuration for the inner barrels may include a tubular extension 406-1 associated with the inner barrel 416-1 and extending longitudinally along a center axis 436 from the threaded end 432-1 of the inner barrel 416-1 and further includes a tubular extension 406-2 associated with the inner barrel 416-2 and extending longitudinally along the center axis 436 from a threaded end 432-2 of the inner barrel 416-2. As an additional example, with reference to FIG. 5B, a configuration may include a lower connector sub 530 with a tubular extension 506 extending longitudinally along a center axis 536 from a threaded end 532-2 of the connector sub 530 or the inner barrel 516-2.

At step 604, a connection, including at least one outer connector member and/or connector sub, is installed on one inner barrel and associated components. For example, with reference to FIG. 3A, the upper connector sub 324 is installed on the inner barrel 316-1. Also, with reference to FIG. 4A, the upper connector sub 424 is installed on the inner barrel 416-1 and associated tubular extension 406-1. As another example, with reference to FIG. 5A, the upper connector sub 524 is installed on the inner barrel 516-1.

At step 606, the connection, including at least one outer connector member and/or connector sub, is installed on the second inner barrel and associated components. For example, with reference to FIG. 3A, the lower connector sub 330 is installed on the inner barrel 316-2 and associated tubular extension 306. As additional example, with reference to FIG. 4A, the lower connector sub 430 is installed on the inner barrel 416-2 and associated tubular extension 406-2. As another example, with reference to FIG. 5A, the lower connector sub 530 is installed on the inner barrel 516-2 and associated tubular extension 506. Additionally, the middle connector sub 525 is installed on the lower connector sub 530 and is associated with the stabilizer 528.

At step 607, a union nut, and/or other outer connector member, is used to connect two adjacent connector subs and subsequently, the two inner barrels are connected. For example, with reference to FIG. 3A, the union nut 326 is installed to connect the upper connector sub 324 and the lower connector sub 330. As additional example, with reference to FIG. 4A, a union nut 426 is installed to connect the upper connector sub 424 and the lower connector sub 430. As another example, with reference to FIG. 5A, a union nut 526 is installed to connect the upper connector sub 524 and the lower connector sub 530.

At step 608, an operator determines whether there are additional inner barrels to couple together. If there are additional inner barrels to couple, method 600 may return to step 602 to install the next connection and inner barrel. If there are no additional inner barrels to couple, method 600 may proceed to step 610.

At step 610, an operator uses the coupled inner barrels during a coring operation. During the coring operation, the inner barrels are lowered into an outer barrel, collect a core sample, such as a core of rock, and return to the surface. For example, with reference to FIG. 2, the inner barrels 216 are coupled using connections 222. The inner barrels 216 are lowered into the outer barrel 118 to collect the core sample 220. Once the core sample 220 is housed in the inner barrels 216, the inner barrels 216 return to the well site 106.

At step 612, an operator separates the inner barrels, such as, by unscrewing a union nut. For example, with reference to FIGS. 3A and 3B, the connection 322 may be disconnected by unscrewing the union nut 326. As another example, with reference to FIGS. 4A and 4B, the connection 422 may be disconnected by unscrewing the union nut 426. As an additional example, with reference to FIGS. 5A and 5B, the connection 522 may be disconnected by unscrewing the union nut 526. After disconnection of each connection, the inner barrels may be separated.

At step 614, an operator separates the core sample, such as, by shearing through a slot on a connector sub and/or outer connector member. Separation may be accomplished by severing the core sample through a slot positioned on a connector sub. For example, with reference to FIGS. 3A and 3B, the core sample, such as a core of rock, may be severed through slot 317 on the upper connector sub 324, and/or in the exposed distance that corresponds to the gap 334 between the end of the inner barrel 316-1 and the end of the tubular extension 306. As another example, with reference to FIGS. 4A and 4B, the core sample may be severed through slot 429 on the upper connector sub 424, and/or in the exposed distance that corresponds to the gap 434 between the end of the tubular extension 406-1 and the end of the tubular extension 406-2. As an additional example, with reference to FIGS. 5A and 5B, the core sample may be severed through slot 527 on the upper connector sub 524, and/or in the exposed distance that corresponds to the gap 534 between the end of the inner barrel 516-1 and the end of the tubular extension 506. At step 616, the severed core sample undergoes further processing while fully protected by the inner barrels, one or more connector subs, and/or one or more tubular extensions.

Embodiments disclosed herein include:

A. A coring apparatus includes a first inner barrel, a second inner barrel, and a tubular extension between adjacent ends of the first and second inner barrels. The coring apparatus includes an outer connector member moveably positioned about the tubular extension and configured for releasably connecting the first and second inner barrels. The first and second inner barrels and tubular extension define a substantially continuous tubular inner structure to receive a core sample.

B. A method for protecting a core sample includes coupling a first inner barrel and a second inner barrel. The first inner barrel including a tubular extension between adjacent ends of the first and second inner barrels. The method further includes installing an outer connector member moveably positioned about the tubular extension and configured for releasably connecting the first and second inner barrels. The first and second inner barrels and tubular extension defining a substantially continuous tubular inner structure to receive a core sample. The method includes using the first and the second inner barrels during a coring operation to extract a core sample, disconnecting the outer connector member, and separating the first and second inner barrels.

Each of embodiments A and B may have one or more of the following additional elements in any combination: Element 1: further comprising an outer thread on at least one of the first or second inner barrels; and a corresponding inner thread on the outer connector member, wherein the outer connector member is rotatable about the tubular extension to engage the corresponding inner thread with the outer thread. Element 2: further comprising a gap between the tubular extension and the second inner barrel to expose a corresponding distance of a core sample for severing. Element 3: wherein the distance is sufficient for severing the core sample with a blade. Element 4: further comprising a second tubular extension on the second inner barrel. Element 5: further comprising a gap between the tubular extension and the second tubular extension to expose a corresponding distance of a core sample for severing. Element 6: further comprising a connector sub connected to the first inner barrel, the connector sub including the tubular extension. Element 7: further comprising a gap between the tubular extension on the connector sub and the second inner barrel to expose a corresponding distance of a core sample for severing. Element 8: further comprising a second connector sub coupled to the second inner barrel, the second connector sub including a second tubular extension. Element 9: further comprising a gap between the tubular extension on the connector sub and the second tubular extension on the second connector sub to expose a corresponding distance of a core sample for severing. Element 10: wherein separating the first and second inner barrels further comprises severing the core sample using a slot on the outer connector member. Element 11: further comprising providing a gap between the tubular extension and the second inner barrel to expose a corresponding distance of a core sample. Element 12: further comprising providing a gap between the tubular extension and the second tubular extension to expose a corresponding distance of a core sample.

Although the present disclosure and its advantages have been described in detail, it should be understood that various changes, substitutions and alternations can be made herein without departing from the spirit and scope of the disclosure as defined by the following claims.

What is claimed is:

1. A coring apparatus comprising:

a first inner barrel;

a second inner barrel;

a tubular extension between adjacent ends of the first and second inner barrels that forms a gap between the tubular extension and the second inner barrel to expose a corresponding distance of a core sample; and an outer connector member moveably positioned about the tubular extension and configured for releasably connecting the first and second inner barrels, the first and second inner barrels and tubular extension defining a substantially continuous tubular inner structure to receive a core sample.

2. The apparatus of claim 1, further comprising:

an outer thread on at least one of the first or second inner barrels; and a corresponding inner thread on the outer connector member, the outer connector member rotatable about the tubular extension to engage the corresponding inner thread with the outer thread.

3. The apparatus of claim 1, wherein the corresponding distance is sufficient for severing the core sample with a blade.

4. The apparatus of claim 1, further comprising a second tubular extension on the second inner barrel.

5. The apparatus of claim 4, further comprising a gap between the tubular extension and the second tubular extension to expose a corresponding distance of the core sample for severing.

6. The apparatus of claim 5, wherein the corresponding distance is sufficient for severing the core sample with a blade.

7. The apparatus of claim 1, further comprising a connector sub connected to the first inner barrel, the connector sub including the tubular extension.

8. The apparatus of claim 7, further comprising a first gap between the tubular extension on the connector sub and the second inner barrel to expose a first corresponding distance of the core sample for severing.

9. The apparatus of claim 8, wherein the first corresponding distance is sufficient for severing the core sample with a blade.

10. The apparatus of claim 7, further comprising a second connector sub coupled to the second inner barrel, the second connector sub including a second tubular extension.

11. The apparatus of claim 10, further comprising a second gap between the tubular extension on the connector sub and the second tubular extension on the second connector sub to expose a second corresponding distance of the core sample for severing.

12. The apparatus of claim 11, wherein the second corresponding distance is sufficient for severing the core sample with a blade.

13. A method for protecting a core sample comprising:

coupling a first inner barrel and a second inner barrel, the first inner barrel including a tubular extension between adjacent ends of the first and second inner barrels that forms a gap between the tubular extension and the second inner barrel to expose a corresponding distance of a core sample;

installing an outer connector member moveably positioned about the tubular extension and configured for releasably connecting the first and second inner barrels, the first and second inner barrels and tubular extension defining a substantially continuous tubular inner structure to receive a core sample;

using the first and second inner barrels during a coring operation to extract the core sample;

disconnecting the outer connector member; and separating the first and second inner barrels.

14. The method of claim 13, wherein separating the first and second inner barrels further comprises severing the core sample using a slot on the outer connector member.

15. The method of claim 13, wherein the corresponding distance is sufficient for severing the core sample with a blade.

16. The method of claim 13, wherein the second inner barrel includes a second tubular extension.

17. The method of claim 16, further comprising providing a gap between the tubular extension and the second tubular extension to expose a corresponding distance of the core sample.

18. The method of claim 17, wherein the corresponding distance is sufficient for severing the core sample with a blade.

* * * * *